US005102135A

United States Patent [19]

Addiechi

[11] Patent Number: 5,102,135

[45] Date of Patent: Apr. 7, 1992

[54] PLURAL CONCENTRIC ROTATING DISC ROULETTE WHEEL FOR A PLURALITY OF BALLS

[76] Inventor: Ricardo Addiechi, 48 No. 633 90 of 908, La Plata, Argentina 1900

[21] Appl. No.: 608,633

[22] Filed: Oct. 31, 1990

Related U.S. Application Data

[63] Continuation of Ser. No. 315,716, Feb. 27, 1989, abandoned.

[30] Foreign Application Priority Data

Jul. 3, 1988 [AR] Argentina ..... 310244

[51] Int. Cl.[5] ..... A63F 5/02

[52] U.S. Cl. ..... 273/142 E; 273/142 HA; 273/274

[58] Field of Search ..... 273/138 R, 142 D, 142 E, 273/142 F, 142 G, 142 HA, 274

[56] References Cited

U.S. PATENT DOCUMENTS 1,560,496 4/1923 Bakketun ..... 273/142 E
2,601,985 7/1952 Yerkes ..... 273/138 R

FOREIGN PATENT DOCUMENTS 0193556 3/1923 United Kingdom ..... 273/142 E
0607730 9/1948 United Kingdom ..... 273/142 E
1113663 5/1968 United Kingdom ..... 273/274

*Primary Examiner*—Edward M. Coven
*Assistant Examiner*—William M. Pierce
*Attorney, Agent, or Firm*—Kuhn and Muller

[57] ABSTRACT

An improved roulette game whose rotor has a conical surface sloped towards its center, in which is placed a central rotating disk coaxially on the rotor mounting shaft, the rotor being free to rotate on its shaft and its conical inclined surface terminating abruptly in a lateral annular surface which leaves a free space from that surface to the shaft secured coaxially to the mentioned rotor and from that annular surface a plurality of projecting walls extend radially defining, between each pair of adjacent walls, a pocket to contain the ball used in the game. The pockets thus defined are frontally closed by another annular wall belonging to the central rotating disk. The latter is placed in the free space existing between the pockets and the rotor mounting shaft, and its annular wall has a height substantially similar to that of the rotor annular wall. The central rotating disk has a conical slope whose lower edge coincides with the pockets. The conical slopes of both rotating bodies define a common travelling path for the playing balls. The central rotating disk rotates on its own axis independently of the rotor and coaxial to it and has at least one projecting fin secured radially to its periphery and extending radially over the pockets at a height superior to that of the diameter of a ball therein lodged and inferior to that equivalent to two balls.

1 Claim, 2 Drawing Sheets

PLURAL CONCENTRIC ROTATING DISC ROULETTE WHEEL FOR A PLURALITY OF BALLS

This application is a continuation of application Ser. No. 315,716, filed Feb. 27, 1989, now abandoned.

This invention relates to a game appliance, and particularly to a game of the roulette type.

FIELD OF THE INVENTION

The improvement of games appliances of the roulette type of which this invention is an object, feature a circular base of the kind which allows at least a circular wheel to rotate therein, propelled by a spindle or the like.

At least one ball may travel along sloped raceways provided by said circular base and circular spinning wheel and then lodge inside pockets or compartments provided at the common boundary of the raceways.

Convenient numbers or symbols are placed in connection to these pockets of compartments providing different values for at least some of said pockets or ball compartments.

The commonly known roulette features a precision balanced wheel, numbered from 1 to 36, and having one "0" or two "0 0" zeros, engraved at the periphery or edge of the compartments into which the ball falls.

The numbers may be alternatively red and black, while the zeros are usually green.

The spinning wheel is turned into a direction, and a ball is spun in the opposite direction, along a path provided by the stationary base.

When the ball loses its momentum and falls within one of the numbered compartments or pockets, the player may face substantially twelve different bets:

| Type of bet | number on bet on the layout at each bet | Payment rate |
|---|---|---|
| 1-single number (plein) | 1 | 35 to 1 |
| 2-on two numbers (cheval) | 2 | 17 to 1 |
| 3-on three numbers | 3 | 11 to 1 |
| 4-on four numbers (carre) | 4 | 8 to 1 |
| 5-on six numbers | 6 | 5 to 1 |
| 6-on column | 12 | 2 to 1 |
| 7-on dozen | 12 | 2 to 1 |
| 8-on column (cheval) | 24 | ½ to 1 |
| 9-on dozen (cheval) | 24 | ½ to 1 |
| 10-red or black | 18 | 1 to 1 |
| 11-high/low (passe manque) | 18 | 1 to 1 |
| 12-even or odd | 18 | 1 to 1 |

The winning possibilities range from 1:1 for single chances up to 1:37 and 1:38 for single numbers (depending on the number of zeros).

The number of probabilities, the actual place where the game is performed and the amounts paid to the winning parties limit the number of players who can directly participate at each roulette table.

On the contrary, other games such as bingo, lottery and the like enable the participants to play even if they are not around the table or at the same place. This in turn generates more interest in the game, attracting more players, thus enabling to increase the odds.

As ordinary roulettes have only one spinning ball if in the known French Roulette having only one zero, two balls are spun, with each ball falling into one number, the possible combinations are 666.

If three balls are spun, with each ball falling into one number, the combinations are 7,770.

With four balls, in similar conditions, the possibilities reach up to 66,045 combinations; with five balls, we may have 435,897 possibilities; and with six balls we have 2,324,784 possibilities.

In the American Roulette, having two zeros, the following table may be compiled, with each ball falling into the same number:

| Number of Balls | Combinations |
|---|---|
| 2 | 703 |
| 3 | 8,436 |
| 4 | 73,815 |
| 5 | 501,942 |
| 6 | 2,760,681 |

United Kingdom Patent No. 193,556 features a receptacle containing a rotating body or disk, which rotates on a pivot. This disk provides an inclined surface with pockets and the disk may be rotated with a spindle.

U.S. Pat. No. 1,560,496, starting from a similar conception, provides a circular playing surface, with a plurality of depressions disposed in a circular pattern, and a rotary spinner which has a plurality of radial arms. This spinner, by means of said arms, projects the ball into the compartments or depressions.

United Kingdom Patent No. 1,113,668 shows a wheel mounted for rotation about a vertical axis and carrying a series of spaced pockets arranged in a circle whereby a ball can lodge in any of said pockets, and each pocket is associated with at least one symbol. The wheel is connected to a spindle.

As it can be readily understood, all the devices pertaining to the prior art, provide through differing combinations, a base, or base structure, in which a single wheel or rotary wheel rotates on a vertical support; the periphery of said wheel or base has a plurality of pockets, and one or more balls may be played into said pockets.

In all of these known game devices, it is possible to ensure playing two or more contemporary games, making use of differently colored balls, or more simply, the known game devices cannot ensure the multiplication of the odds by making use of a plurality of balls, since said known devices cannot guarantee that the different balls will effectively lodge in different pockets or compartments.

OBJECT OF THE INVENTION

It is the object of this invention to provide a roulette game device which allows to perform one or more independent roulette games or games thus related, ensuring that the balls therein spun will never fall and lodge into the same compartment.

DETAILED DESCRIPTION OF THE INVENTION

BRIEF DESCRIPTION OF THE PREFERRED EMBODIMENTS

Figure 1:
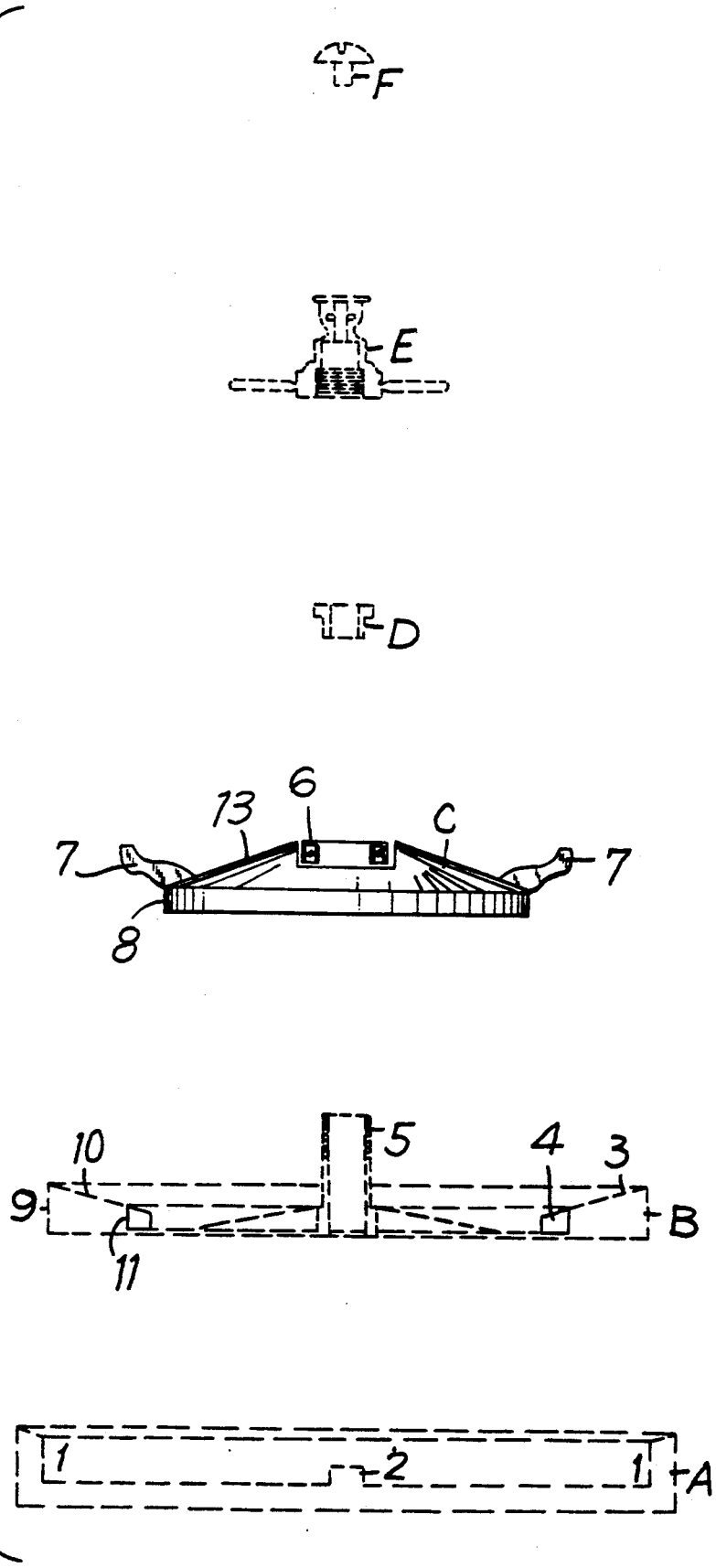
FIG. 1 is an exploded view of the game of this invention, with the intervening pieces placed on the same vertical a is and shown in cross section.
Figure 2:
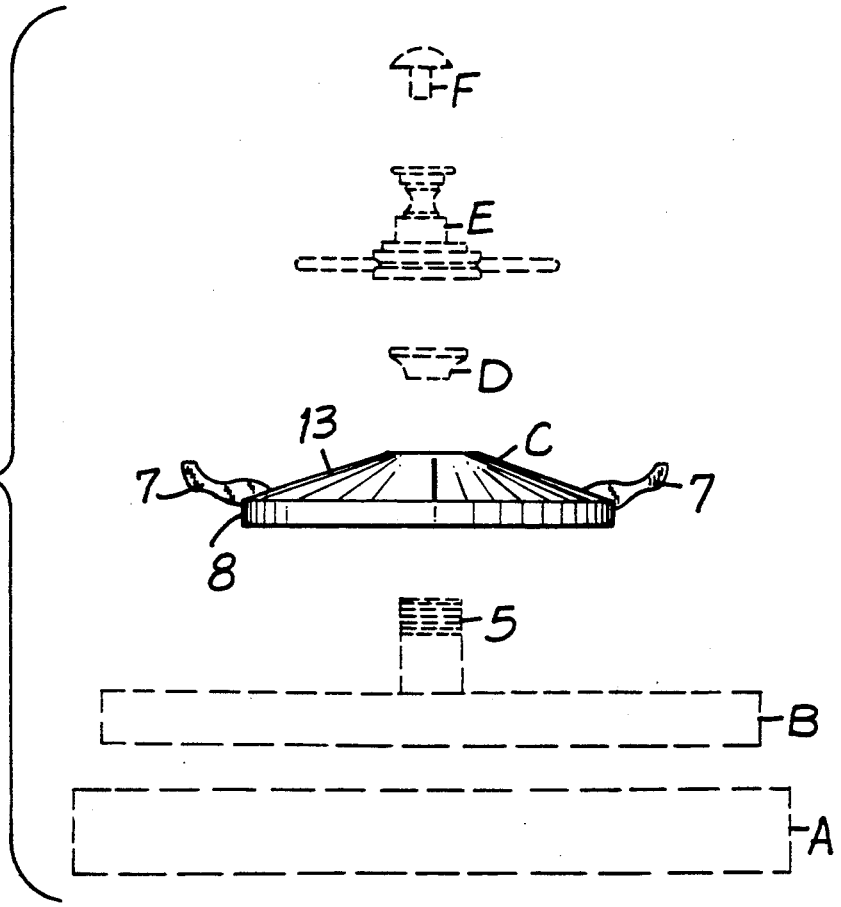
FIG. 2 is a similar view of FIG. 1, but without showing the elements in cross section.
Figure 3:
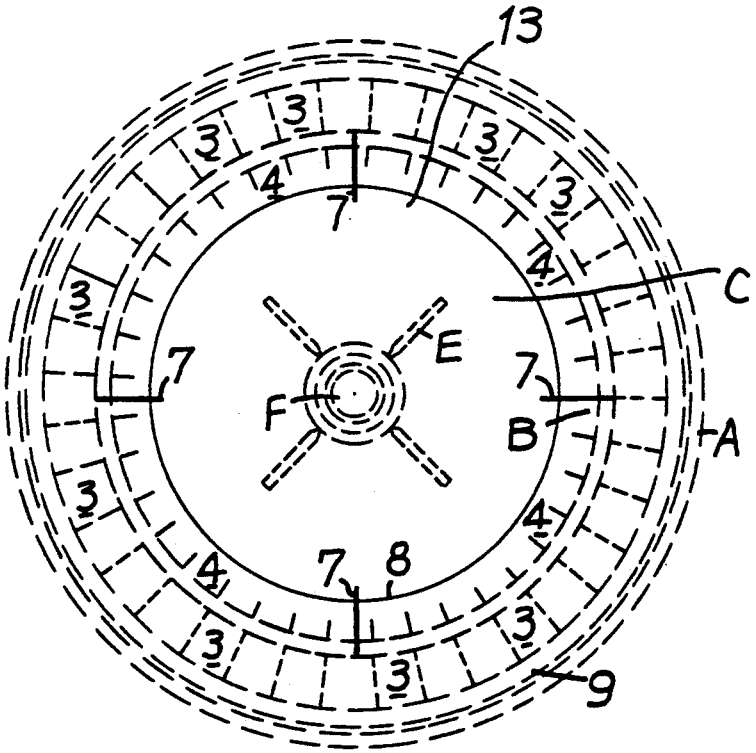
FIG. 3 is a vertical plane view from above of the assembled game device.

In said drawings, A is the base plate which constitutes the basis on which this roulette game rests; it essentially provides a platform from whose center it vertically projects the rotor mounting shaft 2.

This plate A has a recess 1, thus defining a peripheral border, and in said recess 1 is mounted on the shaft 2 a first rotor B, eventually housed inside the recess 1 when available.

The first rotor B has a peripheral side wall 9 from which an inclined conical surface 10 descends towards its center, providing a travelling path for the balls. This surface 10 has lodged or marked thereon the corresponding numbers, indicated with the notation 3.

The inclined surface 10 of the first rotor B ends abruptly defining a vertical annular surface 11, and leaving a free space 12 from 11 up to the shaft 5 which is central to B. This shaft 5 rests on 2 thus allowing the first rotor to turn.

Coaxial to the shaft 5, and rotating independently around it, a second rotating disk C is placed, eventually connected by bearing 6 or the like.

The second rotor C lodges in the space 12 and has a conical shape with upward sloping surfaces 13, in opposition to the slope of 10, thus defining between them two conical annual sloping surfaces of opposed inclination, which are both travelling surfaces for the balls therein spun.

The height of the annular surface 11 is equivalent to the height of surface 8 delimiting the periphery of C, and the annular surface 11 has a plurality of walls radially placed and spaced, defining the plurality of pockets 4 between each pair of adjacent walls. Said pockets 4 are hence contained between said walls, and both annular walls 11 and 8.

The volume of each pocket 8 is sufficient to contain only one ball, while the depth of 4 allows for the thus contained ball to project over the height of said walls. This second rotating disk C has at least one fin 7 secured to its edge. This fin is radially placed and projects over the pockets 4 the height of the lower edge of the fin 7 being inferior to the diameter of the ball.

This rotating disk C is manually and independently driven, being able to rotate in contrarotation to the first rotor B.

The first rotor may be spun by means of the chosshead E, which is threaded at the top and has a plug F, and the visible section of the central shaft 5 of the rotor B is covered by the bushing D.

The fins 7 may be used for spinning the second rotor C, and the fins 7 are responsible for displacing those balls crossing their path. In this way an additional and totally unknown probability factor is added to the roulette.

At the same time these fins ensure that two balls will never be placed on the same number (that is, the same pocket 4 corresponding to its particular identifying number 3), since of any two superimposed balls the one on top is displaced by the rotating fin 7. The balls which are thus hit by the fins 7 will scatter and occupy other pockets 4.

This invention allows for playing multiple roulette games in which two or more balls can be spun according to the games—or combinations of a same game—played. The balls lodged in each pocket will not be dislodged by other balls eventually hitting them.

Although the invention has been herewith described according to a preferred construction, it is obvious that any other constructions having two independently rotating coaxial disks, with pockets in their common boundaries for the lodging of balls, and the scattering fins 7 as above explained, will fall within the scope of the invention, scope which is delimited by the following claim.

What I claim is:

1. Improvements in a roulette wheel having a circular base having an outer periphery on which a rotor is spun coaxial to a vertical axis of said base on a centrally disposed rotor mounting shaft, the base and rotor having upper surfaces determining an inwardly inclined conical travelling path that descends inwardly from the outer periphery of the base towards said rotor mounting shaft for at least one ball therein spun, said travelling path having a plurality of pockets in which said balls may lodge, and on which relevant identifying numbers are inscribed for each of said pockets, the improvement comprising a second rotating disk mounted coaxially on the rotor mounting shaft of the circular base, said rotating disk being located centrally on the rotor mounting shaft with the rotor and the second rotating disk being free to rotate on the mounting shaft; said rotor inwardly inclining upper surface terminating abruptly in a lateral annular peripheral edge which leaves a free space from said inwardly inclining surface to the portion thereof secured coaxially to said rotor mounting shaft, said rotor having a plurality of spaced radially projecting walls extending from said lateral edge defining between each pair of adjacent walls a pocket for containing a ball played by the game; said plurality of pockets in said rotor being frontally closed by an annular wall defining an outer periphery of the rotating disk; said second rotating disk being disposed in the free space existing between the pockets and in said rotor and the rotor mounting shaft, said annular wall of said rotating disk having a height substantially similar to the annular edge of the rotor; said second rotating disk having an outwardly inclined upper conical slope that descends outwardly from said rotor mounting shaft whose lowest portion coincides with the pockets wherein the conical slopes of said rotor and second rotary disc rotating bodies defining a common travelling path for the playing balls, said second rotating disk rotating on its own axis, independently of the rotor and coaxial to it and having at least one projecting fin secured radially to its periphery and extending radially over the pockets; said pockets having a depth smaller than the diameter of the playing balls, and wherein said fin sweeps over said pockets at a height higher than the diameter of a ball therein lodged and inferior to a height equivalent to two different balls lodged into said same pocket.

* * * * *